US005148002A

United States Patent [19]

Kuo et al.

[11] Patent Number: 5,148,002

[45] Date of Patent: Sep. 15, 1992

[54] MULTI-FUNCTIONAL GARMENT SYSTEM

[76] Inventors: David D. Kuo, 17525 NW. Woodmere Ct., Beaverton, Oreg. 97006; Chung S. Chan, 16165 SW. Rosa Rd., Aloha, Oreg. 97007

[21] Appl. No.: 669,073

[22] Filed: Mar. 14, 1991

[51] Int. Cl.[5] ..... H05B 3/34

[52] U.S. Cl. ..... 219/211; 219/529; 219/549

[58] Field of Search ..... 219/211, 212, 528, 529, 219/549

[56] References Cited

U.S. PATENT DOCUMENTS

| | | | |
|---|---|---|---|
| 1,355,382 | 10/1920 | Blume | 219/211 |
| 1,691,472 | 11/1928 | Graham | 219/211 |
| 2,287,915 | 6/1942 | Taylor | 219/211 |
| 2,433,476 | 12/1947 | Munschak | 219/211 |
| 3,385,958 | 5/1968 | Lauck | 219/212 |
| 4,404,460 | 9/1983 | Kerr | 219/211 |
| 4,407,295 | 10/1983 | Steuer | 128/670 |
| 4,651,446 | 3/1987 | Yukawa | 36/132 |
| 4,819,860 | 4/1989 | Hargrove | 128/668 |
| 5,008,515 | 4/1991 | McCormack | 219/529 |

*Primary Examiner*—Teresa J. Walberg

*Attorney, Agent, or Firm*—Marger, Johnson, McCollom & Stolowitz, Inc.

[57] ABSTRACT

A multi-functional garment system includes an outer shell garment (20), detachable inflatable insulation module (30), detachable heating module (40), detachable physiological parameter sensors (208,210), detachable communication module (150) and detachable control and display module (130), the control module including environmental parameter sensors. Modularity of these various functional units allows a user to easily configure the garment system as needed for various activities. The control module provides for storing parameter limits and responses to fault conditions which occur when a parameter exceeds the corresponding limit. Stored responses to fault conditions include controlling any of the functional modules thereby providing improved convenience, comfort and safety.

17 Claims, 10 Drawing Sheets

MULTI-FUNCTIONAL GARMENT SYSTEM

BACKGROUND OF THE INVENTION

The present invention relates to a new field of multi-functional garment systems which are useful for a variety of activities including athletic activities such as bicycling and hiking, as well as activities in adverse weather conditions such as snow camping. Multi-functional garment systems bring together for the first time, in an integrated and modular form, functions and features which heretofore were found only in distinct and separate fields.

For example, electrically heated garments are known. Illustrative examples are the following. U.S. Pat. No. 3,644,705 (Johnson) shows a low voltage, electrically heated shirt. U.S. Pat. No. 3,084,241 (Carrona) shows another electrically heated garment. And U.S. Pat. No. 3,663,797 (Marsh) shows a football jersey having electrically heated pockets for warming the hands. Another electrically heated garment is disclosed in U.S. Pat. No. 3,751,620 (Yuasa).

In most cases, the electrically heated garments are not controllable. Either the heating source is connected to a battery and therefore ON, or it is disconnected and therefore OFF. The patent to Carrona shows use of a thermostatic control.

Another class of garments employ inflatable chambers to improve their insulative capabilities. Examples include the following. U.S. Pat. No. 4,547,906 (Nishida et al) shows a heat-retaining article that includes inflatable envelopes attached to a sheet material. The envelopes are inflated by blowing air into an inlet tube provided for that purpose. A later patent also issued to Nishida et al, U.S. Pat. No. 4,646,366, also shows a garment that includes inflatable chambers. The disclosure states that the insulative properties may be adjusted by controlling the amount of air blown into the pockets and thereby controlling the amount of inflation. A similar type of inflatable garment is disclosed in French Patent No. 2,459,012 (Pastore).

None of these patents suggests any type of automatic inflation or deflation of the garment. Nor do these references suggest combining inflatable chambers with electrical heating means.

Another type of apparatus which was distinct in the prior art, yet is relevant to the present invention, are those that provide for carrying an audio entertainment device such as a radio on the person of a user. Examples of such apparatus are shown in U.S. Pat. No. 4,539,700 (Sato) which shows a vest having a pocket sized to hold a portable radio. A pair of speakers are sewn into the vest, as well as lead wires for interconnecting the radio to the speakers and to a power source. A solar cell power source, attached to the vest, is shown in FIG. 4.

Another portable entertainment device is a neck strap that includes a portable radio, shown in U.S. Pat. No. 4,864,646 (Nesbitt et al). A radio-thermal headband is described in U.S. Pat. No. 4,648,130 (Kuznetz). The Kuznetz patent shows a fabric headband which incorporates a replaceable thermal cartridge for heat as well as a miniature radio set.

An inflatable mattress for use with water-related activities is equipped with a waterproof container for housing an audio signal source, such as a radio, in U.S. Pat. No. 4,856,087 (Nesbitt).

U.S. Pat. No. 4,236,236 (Jaunin) show a timepiece combined with a thermometer. In other words, the electric wristwatch disclosed therein displays both the time and temperature.

U.S. Pat. No. 4,694,694 (Vlakancic et al) discloses a solid state accumulating altimeter which may be worn, for example, on a user's wrist. That device may also have a time display, so that it functions as a wristwatch as well as an altimeter, and a synthesized voice output may be included for audibly reporting data to the user when visual observation of the display is not practical.

Some or all of the various functions cited above, as well as several new functions disclosed below, may be useful at one time or another. However, it is impractical, cumbersome and expensive for a user to buy and maintain separate devices for each of these functions. What is needed is a multi-functional garment system that provides a plurality of selected functions.

SUMMARY OF THE INVENTION

An object of the present invention is to provide a multi-functional garment system that provides a plurality of functions for a user.

Another object of the invention is to provide modularity in a multi-functional garment system to allow a user to readily configure the garment system for a desired application.

Yet another object of the invention is to integrate various functional modules together in a garment system so that the modules operate cooperatively with one another.

A further object of the invention is to monitor physiological parameters of a person and to control functions of the person's garment system responsive to those parameters.

Yet another object of the invention is to integrate heating, control and communication functions within a garment system so as to provide new levels of comfort, convenience and safety for a user.

Another object of the invention is to provide various kinds of information to a user which heretofore required several separate devices. Such information includes physiological data such as pulse rate and body temperature, environmental data such as air temperature and altitude, and additional information received via radio communications. All of these types of input data may be used by the garment system to control various functions of the garment system such as heating, cooling and communications.

According to the present invention, a multi-functional garment system includes an outer shell garment, a sensor detachably coupled to the outer shell for monitoring a physiological parameter of a user, and a control module detachably coupled to the outer shell and to the sensor to provide an indication to the user of the monitored physiological parameter.

The sensor may sense pulse rate or temperature, for example. The control module may include a display for visually displaying the monitored parameters to the user. The control module may further include an audible alarm to notify the user when a monitored physiological parameter exceeds a predetermined limit, settable by the user.

The functions of the garment system include, by way of example and not limitation, insulating the user from the environment, warming the user, cooling the user, providing information to the user (such as the information mentioned above), and even summoning help for the user in an emergency.

According to another aspect of the invention, the garment system includes a portable communication module removable coupled to the outer shell garment. The sensors and the communication module are coupled to the control module for integrated operation to allow transmitting the physiological parameters to another location. This integration allows for the control module to take other actions responsive to detecting an excursion of the physiological parameter outside the predetermined limit. Such other actions may include activating the communication module to transmit an emergency signal. Another response, for example in response to low body temperature, may be activating the heating means.

Some of these functions are application specific. For example, for use of the garment system while jogging or bicycling in the summer, the user may want to receive commercial radio programming and physiological data. The user may want to know environmental conditions (which could even include air quality). The user will have no need, however, for the insulation module, heating module or the heating module power supply. In that case, those modules are simply detached and left at home. The outer garment shell sleeves may be removable for summer use.

For cold weather use, the sleeves, insulation module, heating module and heating module power supply will be desirable. The communication module may be essential for dangerous climbing expeditions, but useless for a long trek out of radio range. It may be installed in the garment system, or omitted as required.

These examples are merely to illustrate the many advantages of a modular garment system. Other advantages arise from the integration of the system. The functional modules cooperate with each other to provide new levels of comfort, convenience and safety for a user.

To illustrate, a sensor, worn about the user's finger or wrist, is coupled to the control and display module to monitor physiological data. The control module may be programmed with physiological parameter limits. It detects departures outside such limits, and may in response be programmed to sound an audible alarm, display a message to the user, activate the communication module to transmit a message, activate the heater module, etc.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Overview

Figure 1A:
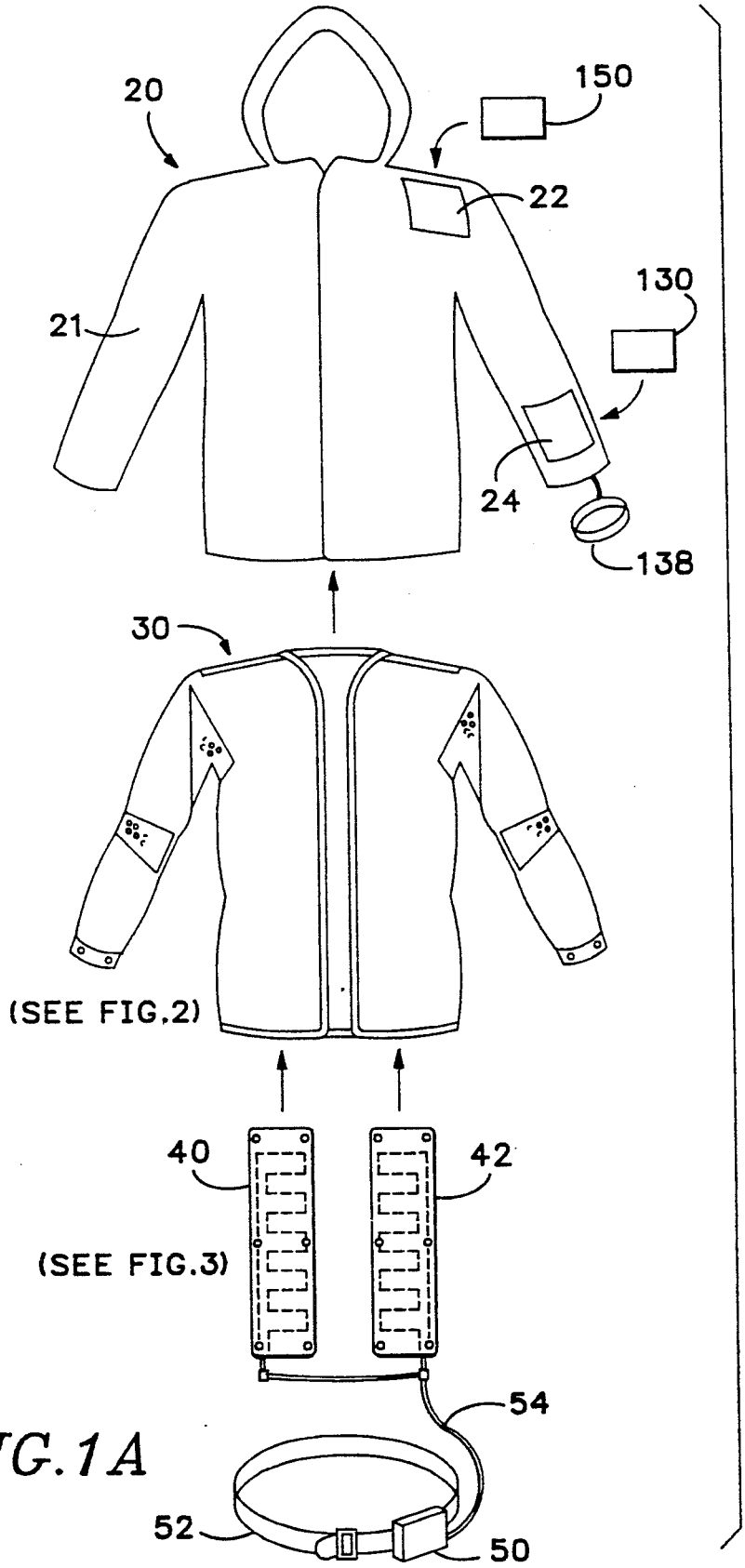
FIG. 1A is an exploded view of a multi-functional garment system according to the present invention.

FIG. 1A is an exploded front view of a multi-functional garment system 20 according to the invention. Referring to the top part of the figure, the garment system includes an outer shell garment 21. Any of a variety of materials are suitable for the outer shell. Preferably, it is formed of a fabric which is lightweight, durable and treatable with water-repellent coatings such as peb-cotton blended fabrics, nylons, or a breathable yet water-repellent fabric such as that sold under the tradename Gortex TM.

For commercial use, the garment system should be available in a variety of sizes to provide good fit and comfort for a variety of users. The outer shell garment 21 includes a covered recess or pocket 22 for housing a radio communication module. Preferably, the radio communication module housing is located in the shoulder region of the garment, for convenient microphone and earphone connections. Additionally, the shoulder region is, in most cases, less likely to be struck as another location might be.

The outer shell garment 21 also includes a second covered recess or pocket 24, located near a distal end of one of the sleeves, for housing a control and display module. This location for the control and display module is preferred because of its proximity to the user's hand or wrist, thereby providing for convenient connections to pulse and temperature sensors and the like, which will be described in detail below. Additionally, the sleeve location facilitates reading the display by moving the hand to bring the display into clear view, much like reading a wristwatch.

Referring now to the middle part of FIG. 1A, an inflatable insulation module 30 is sized to fit within the outer shell garment 21 and is removably attachable therein by zippers, snaps, Velcro TM or other known fastening means.

Referring now to the lower portion of FIG. 1A, a pair of electric heating modules 40, 42 are sized and arranged to attach to the inside of the inflatable insulation module 30. A heating module power supply 50 is carried on a belt 52 and connected to the heating modules, for example, by an electrical cable 54.

Figure 1B:
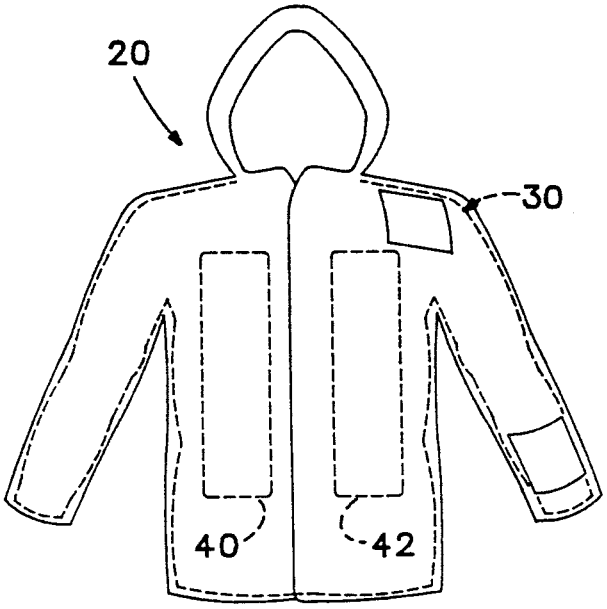
FIG. 1B is a front view of the multi-functional garment system of FIG. 1A showing heating modules and inflatable insulation modules in phantom.

FIG. 1B is a front view of the garment system 20 showing in phantom the location of the inflatable insulation module 30 when it is installed in the outer shell 21, and the locations of electric heating modules 40, 42, as installed within the inflatable insulation module 30.

Figure 1C:
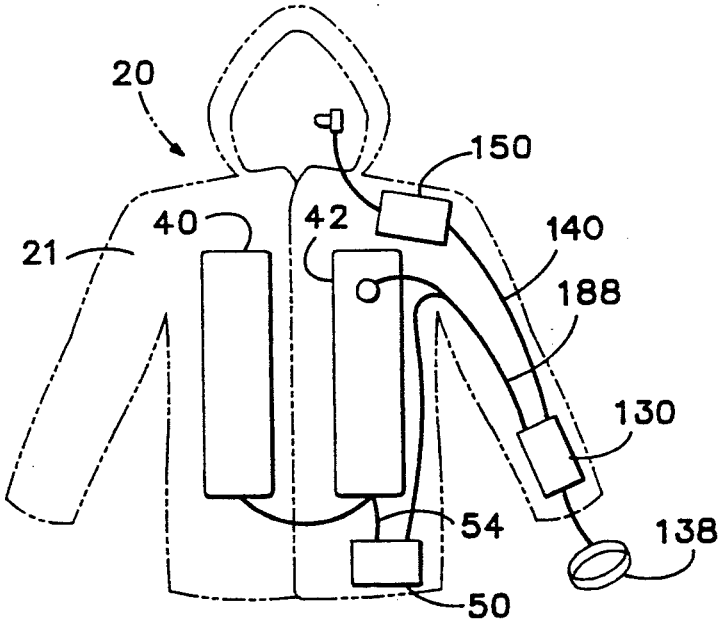
FIG. 1C is a front view of the garment system of FIG. 1A showing selected electrical cable interconnections in phantom.

FIG. 1C shows the locations and interconnections within the garment system 20 of the electric heating modules, heating module power supply 50, radio communication module 150, control and display module 130, and other features of the garment system further described below. FIG. 1C also illustrates the cable connection scheme for interconnecting the functional modules. Each of the functional modules is described in detail in turn below.

Inflatable Insulation Module

Figure 2A:
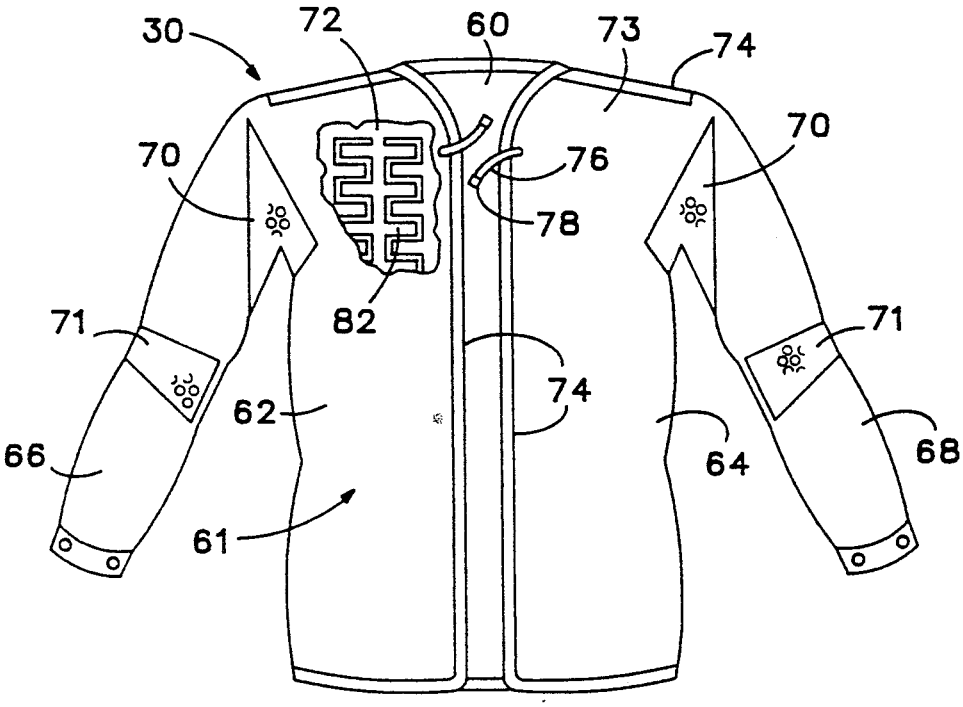
FIG. 2A is a partially cutaway front view of an inflatable insulation module for use in the garment system of FIG. 1.

FIG. 2A is a partially-cutaway front view of the inflatable insulation module 30. Referring to FIG. 2A, the inflatable insulation module 30 is generally shaped to correspond to the outer shell garment and is sized to be inserted therein. Module 30 is removably connected to the outer shell garment, for example by snaps, Velcro TM, zippers or the like. The interior surface of the insulation module includes fastening means (not shown) corresponding to the snaps or Velcro TM fastening means 112 (FIG. 5) of the heating module for detachably connecting the heating module within the insulation module.

The insulation module further includes inflatable regions located, for example, on the front panels 62,64 and on the back panel. The inflatable regions include a least one inflatable envelope 82, further described below.

The insulation module is constructed of an inside layer 60 and an outside layer 73. The inflatable envelope 82 is disposed between the inside and outside layers, and connected to one of them to retain it in position. Inside layer 60 may be formed of any suitable sheet material, preferably a relatively thin yet insulated fabric. Outside layer 73 may be formed of a breathable yet water resistant fabric, or of an air-impermeable fabric. In the latter case, vent holes 85 are provided as illustrated to allow water vapor to escape from between the two layers.

Figure 2B:
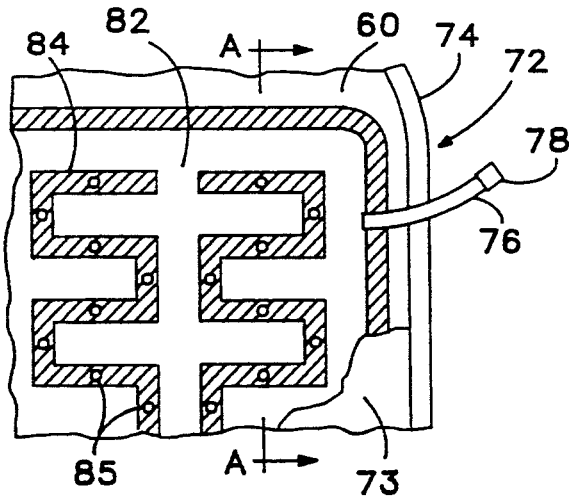
FIG. 2B is an enlarged sectional view showing detail of a portion of the inflatable insulation module of FIG. 2A.
Figure 2C:
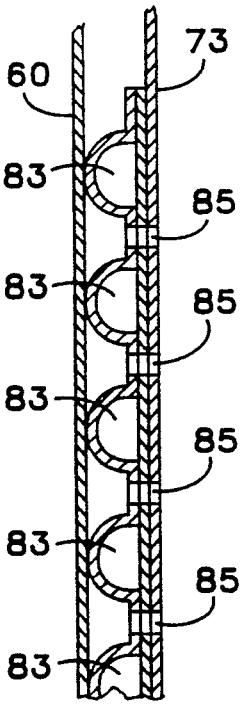
FIG. 2C is a cross-sectional view taken along line A—A of FIG. 2B.

Referring now to FIGS. 2B and 2C, the inflatable envelope 82 is formed of parallel sheets of an air-impermeable material, such as a medium-density polyethylene or a fabric coated or laminated with a rubber, urethane or similar material. The parallel sheets are sealed together along their edges, for example by adhesion, welding, or a heat-sealing process so as to form the envelope. The envelope is divided into plural interconnected chambers 83 by further welding or adhesion in order to minimize the effect of an accidental puncture. The chambers may be arranged in various ways, designed to maximize insulative capability while maintaining comfort and freedom of motion when inflated. Examples include forming elongate, tubular chambers or sealing the envelope sheets together as illustrated in FIG. 2B, i.e., along a boustrophedonic path 84.

Referring again to FIG. 2A, the inflatable envelope does not extend into armpit regions 70 or into elbow regions 71 in order to facilitate movement and prolong the life of the inflatable insulation module. An air inlet tube 76 extends through an aperture in the outside layer to allow blowing air into the air chambers and to allow air to escape. An air lock valve 78 is provided in connection with the air inlet tube 76. Additional details of construction of an inflatable garment are known and are shown in U.S. Pat. No. 4,547,906 which is incorporated herein by this reference.

Electrical Heating Module

Figure 3A:
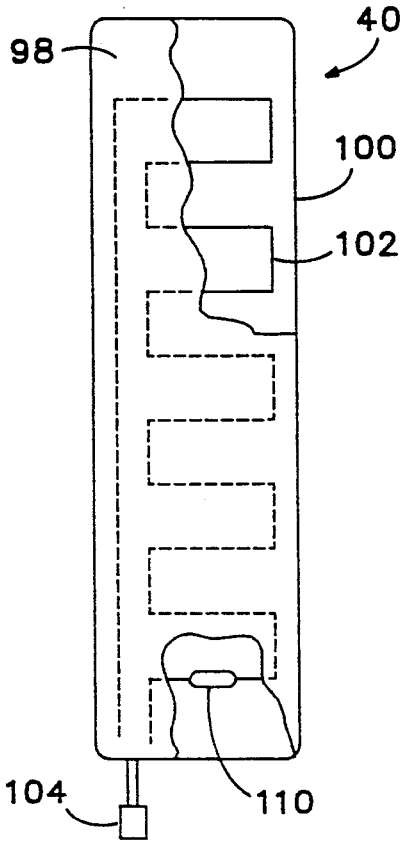
FIG. 3A is a partially cutaway front view of a heating module for use in the garment system of FIG. 1.
Figure 3B:
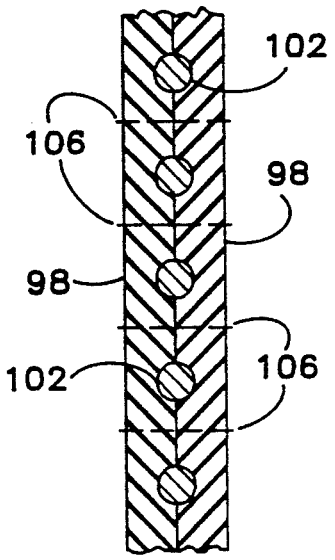
FIG. 3B is a cross-sectional view of the heating module of FIG. 3A.
Figure 4A:
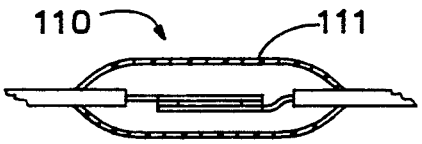
FIG. 4A is a side view of a safety switch for use in connection with the heating module of FIG. 3.
Figure 4B:
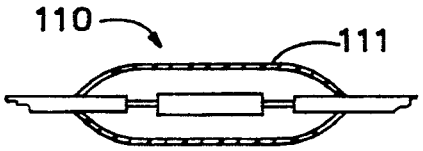
FIG. 4B is a top view of the safety switch of FIG. 4A.
Figure 5:
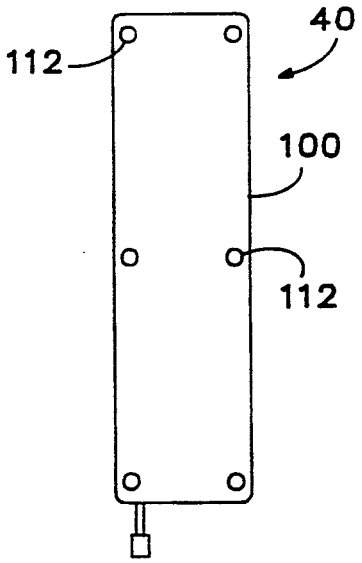
FIG. 5 is a front view of the heating module of FIG. 3 showing an example of fasteners for connecting the heating module into the garment system of FIG. 1.

The electrical heating module is illustrated in FIGS. 3-5. FIG. 3A is a partially cut-away front view of a heating module 40 for use in the garment system of FIG. 1. The heating module 40 comprises a mat 98 of insulation material. A heating wire 102 is imbedded in the insulation material. A nylon thread is sewn through the mat 98 to hold heating wire 102 in place. Preferably, the heating wire 102 is imbedded in insulation material by positioning it between two similar mats of insulating material such as mat 98. In such an arrangement, nylon thread 106 sewn through the insulating material serves both to hold the heating wire in place and hold the two insulation mats together.

The heating wire is coupled through a safety to a plug 104 extending out of the heating module 40 for connection to a suitable power source. The heating module 40 is formed to a material and construction similar to electric blankets which are commercially available. Such blankets are made, for example, of 50% polyester and 50% arcylic with nylon binding. An operative example of such a heating module measures approximately 8"×12". The electrical operating parameters are as follows:

Voltage: 7.2 vdc
Current: 0.75 amp
Power: 5.4 watts

The total heat generated in four hours of continuous use is approximately 78,000 joule.

FIG. 4A shows enlarged side and top views of the safety switch 110. The safety switch is arranged to limit the current flow through the heating wire. For example, a bimetallic switch may be used to disconnect the circuit when the current flow is excessive. A bimetallic switch automatically reconnects the circuit after some delay. Safety switch 110 is sealed in a waterproof capsule 111.

FIG. 5 illustrates one example of a means for removably connecting the heating module 40 into the insulation module 30. In FIG. 5, a plurality of fastening means 112, such as snaps as Velcro TM, are distributed over the heating element for securely attaching it to the insulation module while allowing easy removal when the heating unit is not needed.

Control and Display Module

Figure 6A:
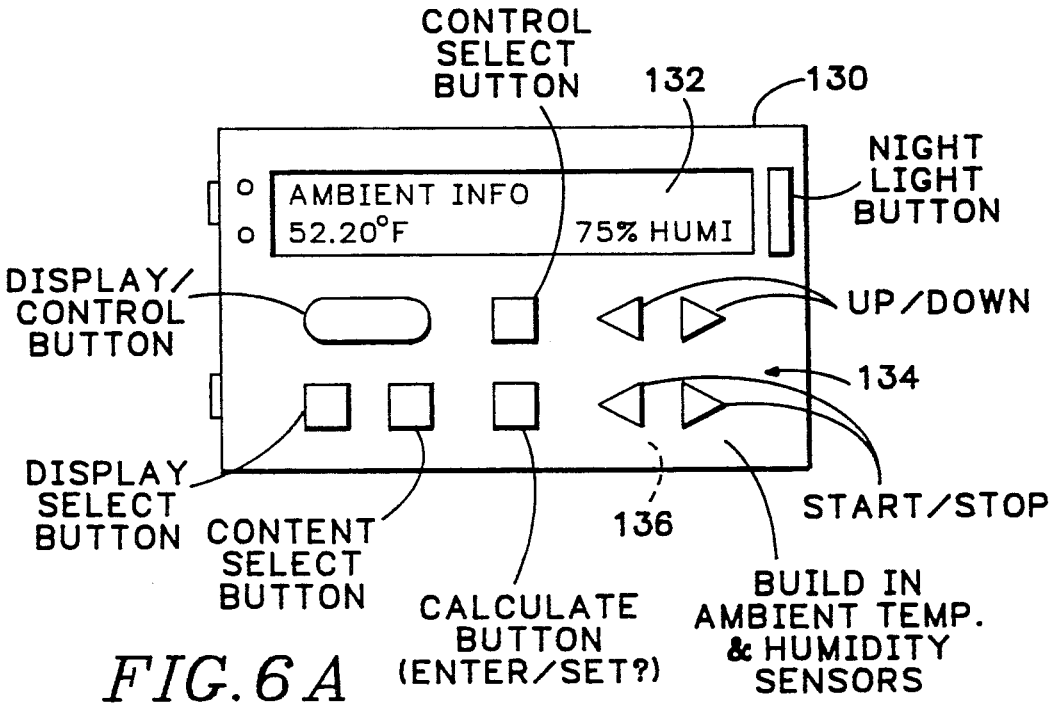
FIG. 6A is a front view of a control and display module for use in the garment system of FIG. 1.

FIG. 6A is a front view of an electronic control and display module 130 (hereafter simply "control module")

for use in the garment system of FIG. 1. The control module provides integration among various other functional modules. In general, the control module operations include:

(1) maintaining preset or default parameter limits;
(2) maintaining limits set or modified by a user;
(3) continuously monitoring various input parameters;
(4) comparing the monitored parameters to the corresponding limits to detect fault conditions;
(5) taking actions responsive to fault conditions; and
(6) displaying parametric information to the user.

Operation of the control module may be described in terms of the user interface, as follows. The control module 130 includes a display 132 which may be, for example, a liquid crystal display. Any of various display technologies might be employed in the display with the goal of good readability in sunlight while minimizing power consumption.

The control module modes of operation include display modes and control modes. Display modes may include displaying the following information to the user, by way of illustration and not limitation:

Mode 1: Ambient temperature and humidity
Mode 2: Time, day, date, alarm clock, stopwatch
Mode 3: Skin temperature, pulse rate
Mode 4: Step count, steps/minute, energy consumption A simple button may be used to cycle through the above display modes. Information available for display to the user may come from three sources: (1) generated or maintained by the control module itself, such as time of day or stopwatch elapsed time; (2) acquired by sensors disposed within or coupled to the control module, such as ambient temperature, user skin temperature, battery voltage or altitude; and (3) calculated by the control module from acquired data, such as user pulse rate or step cadence. The foregoing are intended as examples and not limitations.

A second button may be used to toggle the control module between the display modes and control modes. Control modes of operation are used to control functional modules directly, for example to activate a heating or cooling module, and to set or modify various parameter limits thereby defining fault conditions. A fault condition occurs when a monitored parameter reaches or exceeds the corresponding limit. To illustrate, available control modes may include the following:

Mode 1: Time/Date/Day changing
Mode 2: Stopwatch start/stop/reset
Mode 3: Heating and Cooling direct control
Mode 4: Step count start/stop/reset
Mode 5: Set/Modify Parameter limits
Mode 6: Automatic heating control (responsive to ambient temperature, body temperature or time of day)
Mode 7: Communication module programming Modes 1 and 2 are conventional clock, calendar and stopwatch functions. Mode 3 provides for manual control of the heating and cooling modules. Mode 4 controls a step counter function. Mode 5 provides for setting and modifying parameter limits. These may include the following:

| | |
|---|---|
| pulse rate | maximum |
| user skin temperature | minimum/maximum |

-continued

| | |
|---|---|
| ambient temperature | minimum/maximum |
| elapsed time | time |

Each limit defines a corresponding fault condition. For example, user skin temperature minimum defines a fault condition, while ambient temperature maximum defines another fault condition. The control module may be programmed to take a specific action in response to each fault condition.

Actions responsive to fault conditions may include, by way of illustration:

activating an audible alarm;
displaying a message to the user;
activating transmission by the communication module;
activating or deactivating another module such as the heating or cooling modules; activating the solar recharger module to recharge a battery pack.

The foregoing merely illustrate the kinds of actions which are available using an integrated garment system of the type described herein. Examples of appropriate actions include the following: (1) Sound an alarm in response to a high pulse rate fault condition; (2) Activate the cooling module in response to a high skin temperature fault condition; (3) activate the communication module to receive a weather report at a predetermined time (i.e. in response to a stopwatch or time of day "fault condition"). Furthermore, if the body temperature falls below a certain predetermined minimum and the heating module has been programmed for a predetermined amount of time, the unit may be programmed to actuate the communication module to transmit an emergency signal. Provision can be made to provide an indication to the user that the system is going to transmit an emergency signal, unless the user intervenes. This way, if the user is disabled and therefore cannot intervene, an emergency signal is transmitted automatically. Many other examples will become apparent in view of this disclosure.

The control module 130 includes various buttons, 134 for directly controlling specified modules, for setting parameter limits, and for programming fault condition responses. For example, to set a pulse rate limit: (1) select control mode; (2) select the pulse rate parameter (for example by repeatedly pressing a parameter select button to step through a predetermined sequence of parameters); (3) enter the desired limit value (for example by actuating UP and/or DOWN buttons in order to drive the display to the desired limit value, such as 160 beats per minute; and (4) press an ENTER or SET button to store the limit setting.

Figure 6B:
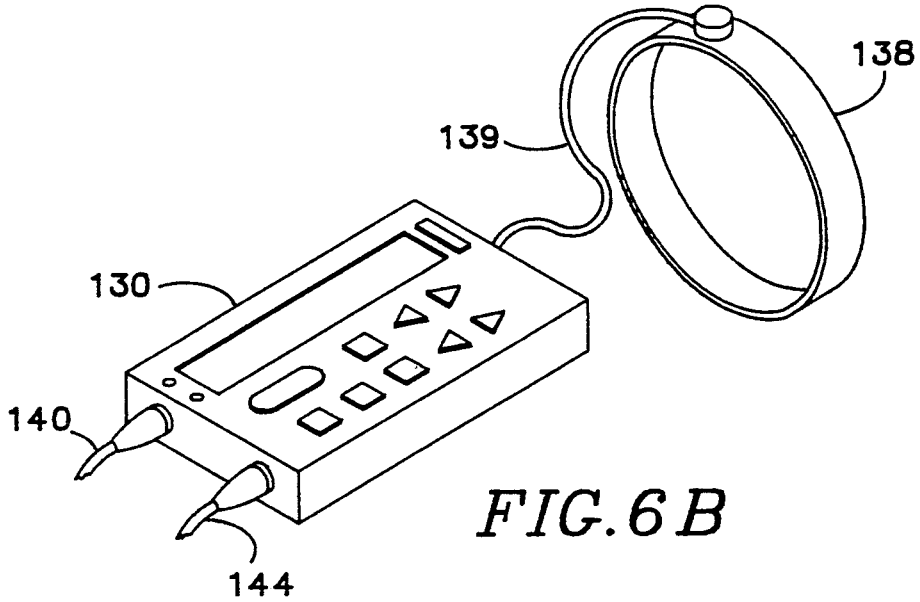
FIG. 6B is a perspective view of the control and display module of FIG. 6A showing sensor and cable connections.

FIG. 6B shows the control and display module 130 in perspective view, and shows connections of a skin temperature and pulse sensor 138 which may take the form of a wrist strap or a ring to be worn on a finger. A sensor 138 is connected to the control module 130 over a suitable cable 139. The cable 139 terminates at a plug and the control module 130 includes a corresponding jack for receiving the plug so that the sensor is easily disconnected when it is not required. An electrical cable 140 is provided for interconnecting the control module 130 to the radio communication module 150, further described below. Additional cables 144 are provided for interconnecting the control module 130 to the heating module power supply for controlling the heating modules.

Radio Communication Module

Figure 7A:
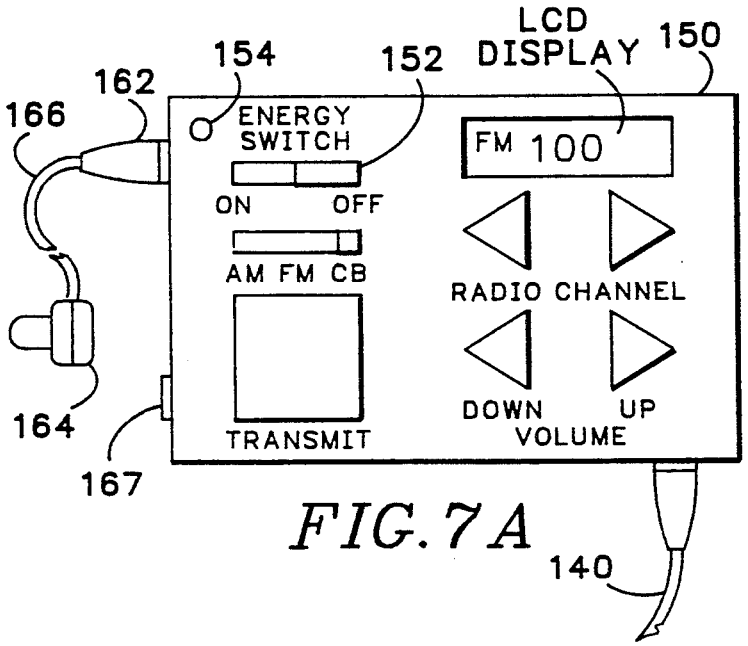
FIG. 7A is a front view of a radio communication module for use in the garment system of FIG. 1.

FIG. 7A is a front view of the radio communication module 150. The communication module preferably includes AM, FM and Citizens Band (CB) radio. In addition to having receiver capability in all three of these bands, the communication module includes transmission capability on at least one of those bands.

The communication module 150 includes a display, such as a liquid crystal display, for displaying information such as frequency, and further includes conventional controls for frequency selection, volume, and the like. The communication module 150 also includes an emergency switch 152 for activating an emergency mode of operation in which the communication module periodically transmits signals at a predetermined emergency frequency to assist rescue personnel in locating the user who may be in distress.

Figure 7B:
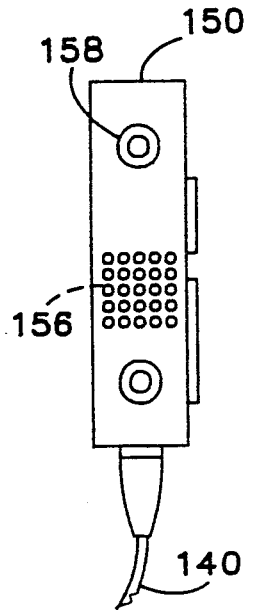
FIG. 7B is a side view of the radio communication module of FIG. 7A.

FIG. 7B is a side view of the radio communication module 150. The module 150 includes a built-in speaker/microphone 156. An earphone jack 158 is provided to receive a corresponding earphone plug 162 (FIG. 7A) which, in turn, is connected to an earphone 164 by a suitable cable 166. Cable 166 may include or serve as an antenna. Another jack 167 is provided to receive a radio direction finder (RDF) antenna.

Patches of Velcro TM or a similar material are affixed to the back side of the communication module 150 for removably attaching the module to the recess 22 provided in the outer shell 21 for that purpose. The recess 22 may be covered by a flap 160 which, in turn, is held in its closed position by snaps, Velcro TM or similar means.

Figure 7C:
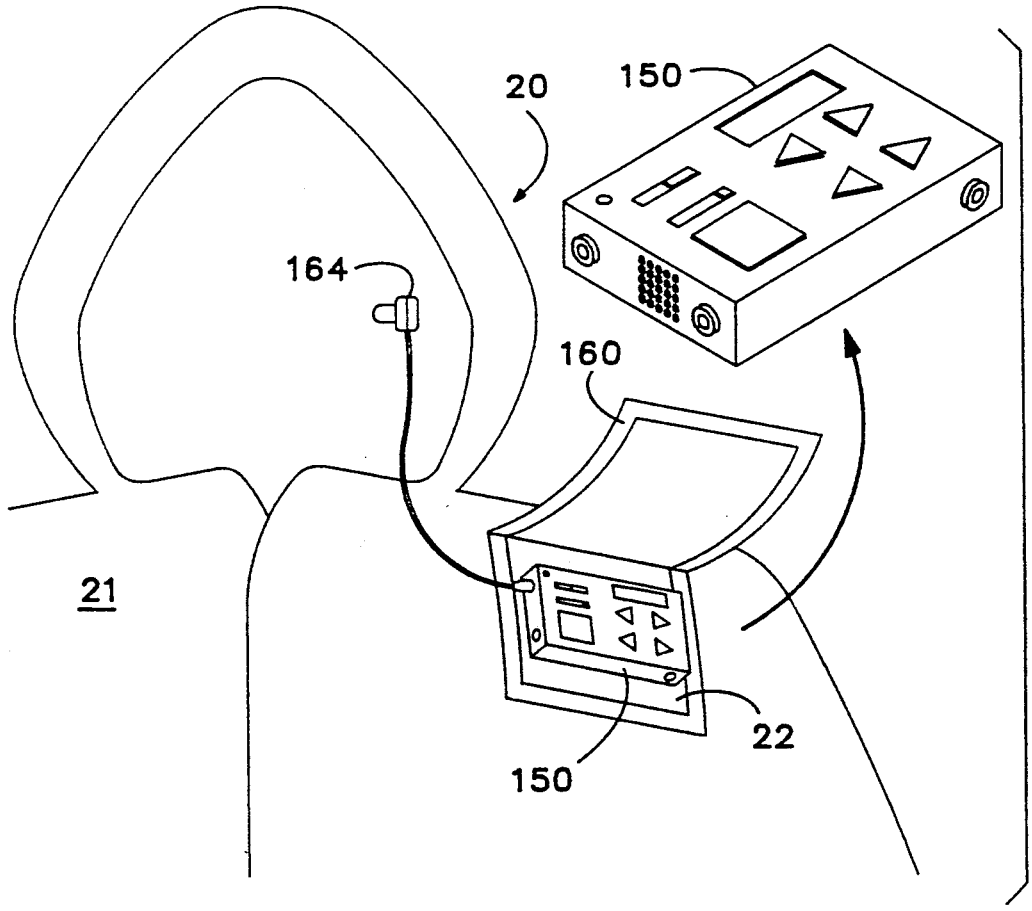
FIG. 7C is a perspective view of a shoulder region of the garment system of FIG. 1 showing housing of the radio communication module of FIG. 7A.

FIG. 7C is a perspective view of a shoulder region of the garment system 20.

Heating Module Power Supply

Figure 8A:
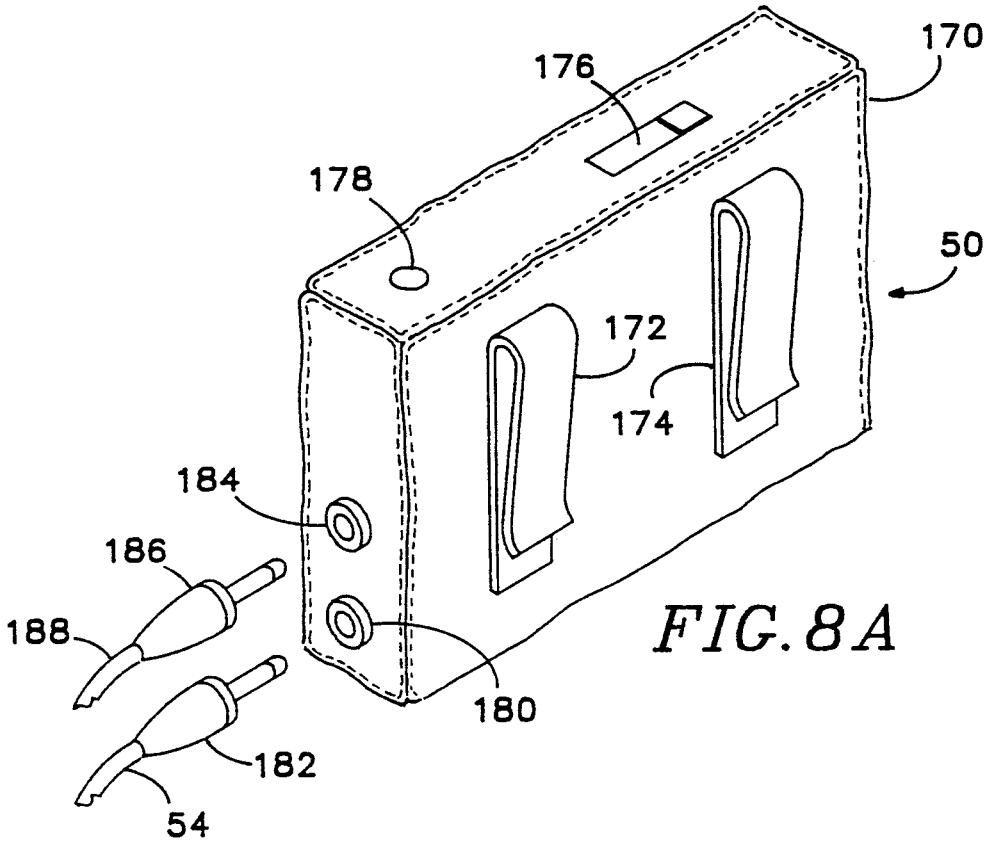
FIG. 8A is a perspective view of a heating module power supply for use in connection with the garment system of FIG. 1.

Referring now to FIG. 8A, the heating module power supply 50 is housed in a suitable waterproof housing 170 which may be formed, for example, of waterproof nylon, coated canvas, or the like, so as to provide sturdiness and light weight. Housing 170 includes a pair of loops or Velcro TM strips 172, 174 for removably attaching the housing 170 to a waist belt (52 in FIG. 1A).

The power supply assembly further includes a master power switch 176 and a power indicator light, such as an LED 178. The master power switch completely disconnects the battery pack (described below). The housing 170 further includes an electrical jack 180 for receiving a corresponding plug 182. Plug 182 is connected to one end of an electrical cable 54 for connecting the power supply to the heating modules 40, 42. The other end of cable 54 is connectable to plug 104 (FIG. 3A). The housing further includes another jack 184 for receiving a corresponding plug 186. Plug 186 is connected to electrical cable 188 for coupling the power supply to the control and display module 130.

Figure 8B:
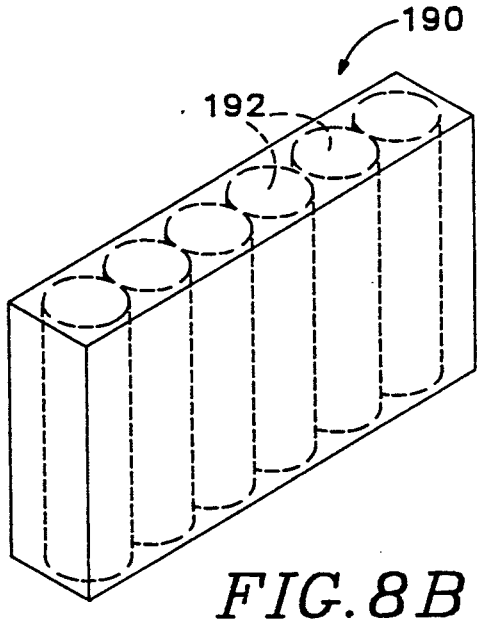
FIG. 8B is a perspective view of a fittable into the heating module power supply of FIG. 8A.

FIG. 8B illustrates a battery pack 190 which, in use, is disposed within housing 170. The battery pack should be water resistant to 3 meters and include a fuse to prevent a short circuit. It may be sealed in plastic packaging, for example. Battery pack 190 comprises a plurality of rechargeable battery cells 192. For example, six rechargeable cells of a nominal 1.2 vdc each may be employed to provide the 7.2 vdc power supply voltage. Preferably, the cells are Nickel-Metal Hydride batteries. The battery pack provides 3 ampere-hours.

A flexible solar charger module may be provided for recharging the battery pack during daylight hours. Flexible solar chargers are known to include a cloth-like material that contains solar cells. Such a charger may be removably connected to the outer shell garment, for example on the back portion, using snaps, Velcro TM or other suitable fasteners. The flexible charger material can be fixed to the garment, but preferably it is removable for convenience in laundering the garment. In full sunlight, a charger of this type can provide five watts of power.

A solid state power switch such as a solid state relay (not shown), preferably located within the power supply module housing 170, is electrically connected between the heating module and the heating module power supply. The solid state power switch is controlled by the Control and Display Module to control the heating module. The power switch can simply be turned ON and OFF as needed, for example in response to body temperature and preset limits. Appropriate hysteresis would be provided as is known in control systems. Or, the switch may be turned ON and OFF periodically at a predetermined frequency, and the duty cycle modulated by the Control Module to control heating and battery drain. Frequency and/or duty ratio may be controlled to optimize performance.

The heating system would operate only if the master power switch was ON. LED 178 could be wired to indicate the state of the master power switch, or the state of the solid state power switch. In the latter case, modulation of the duty ratio would appear as varying the brightness of the LED.

Radio Direction Finder and GPS

Radio direction finders (RDF) are known for locating, or determining the direction of, a distant transmitter. The RDF depends upon a very direction-sensitive antenna, one which receives radio signals only when the antenna is correctly aligned relative to the source of the signals (transmitter). Details of RDF apparatus are known. According to the present invention, a direction-sensitive antenna (RDF antenna) 168 (FIG. 9) may be connected to the communication module 150, at jack 167 (FIG. 7A), for example to assist the user in locating a companion who is using a similar radio communication module to transmit radio signals. The RDF antenna may also be used to determine the direction of a distant radio broadcast station. Since radio broadcast stations typically are located near populated areas, this feature is useful when the user is lost, or to assist in navigation in general. The RDF antenna may be flexible or collapsible for storing it in a pocket in the outer shell garment when not in use.

Recently, the satellite-based Global Positioning System or GPS, developed and operated by the U.S. Department of Defense, has become available for commercial use. A GPS receiver can provide precise location information, sometimes within inches. Portable GPS receivers are now available commercially from Navstar, and are used, for example, in automobiles. A portable GPS receiver may be disposed in the multi-functional garment system to provide location information. It may be coupled to the battery pack for power, and/or coupled to the solar charger module for recharging its battery. A GPS system would be particularly useful during long-distance hiking and climbing beyond the range of commercial broadcast radio.

Electronic Compass Module

An electronic compass module (not shown) can be attached to the outer shell garment, for example on the sleeve, to provide direction information to the user. Details of electronic compasses are known. The electronic compass module can be coupled to, and used in combination with the communication module and RDF antenna to enhance direction-finding capability. The electronic compass may include its own dedicated power source such as a battery, or it may be connected to the battery pack for power.

Solid State Cooling

A semiconductor (thermal-electric) material is known which will generate heat on one side and "coolness"(i.e. absorb heat) on the opposite side, responsive to an applied electric current. In other words, the material conducts thermal energy. Such a material has been used in commercially available electric coolers. According to the present invention, a sheet of thermal-electric material may be connected to the outer shell garment, similar to the connection of electric hearing modules 40, illustrated in FIGS. 1A and 5. Alternatively, the outer shell garment may include an integral layer of thermal-electric material (not shown).

The thermal-electric layer may be powered by the heating unit batter pack 190, and may be controlled by the Control and Display Module 130 in a manner similar to that described with respect to the heating module. The thermal-electric layer may be activated to conduct heat away from the user, thereby cooling the user. It may be activated manually, as by a switch, or automatically by the control module, for example when the user's temperature exceeds a predetermined limit. The limit may be set by the user in the same way that other parameters are set.

Control Logic Flow

Figure 9:
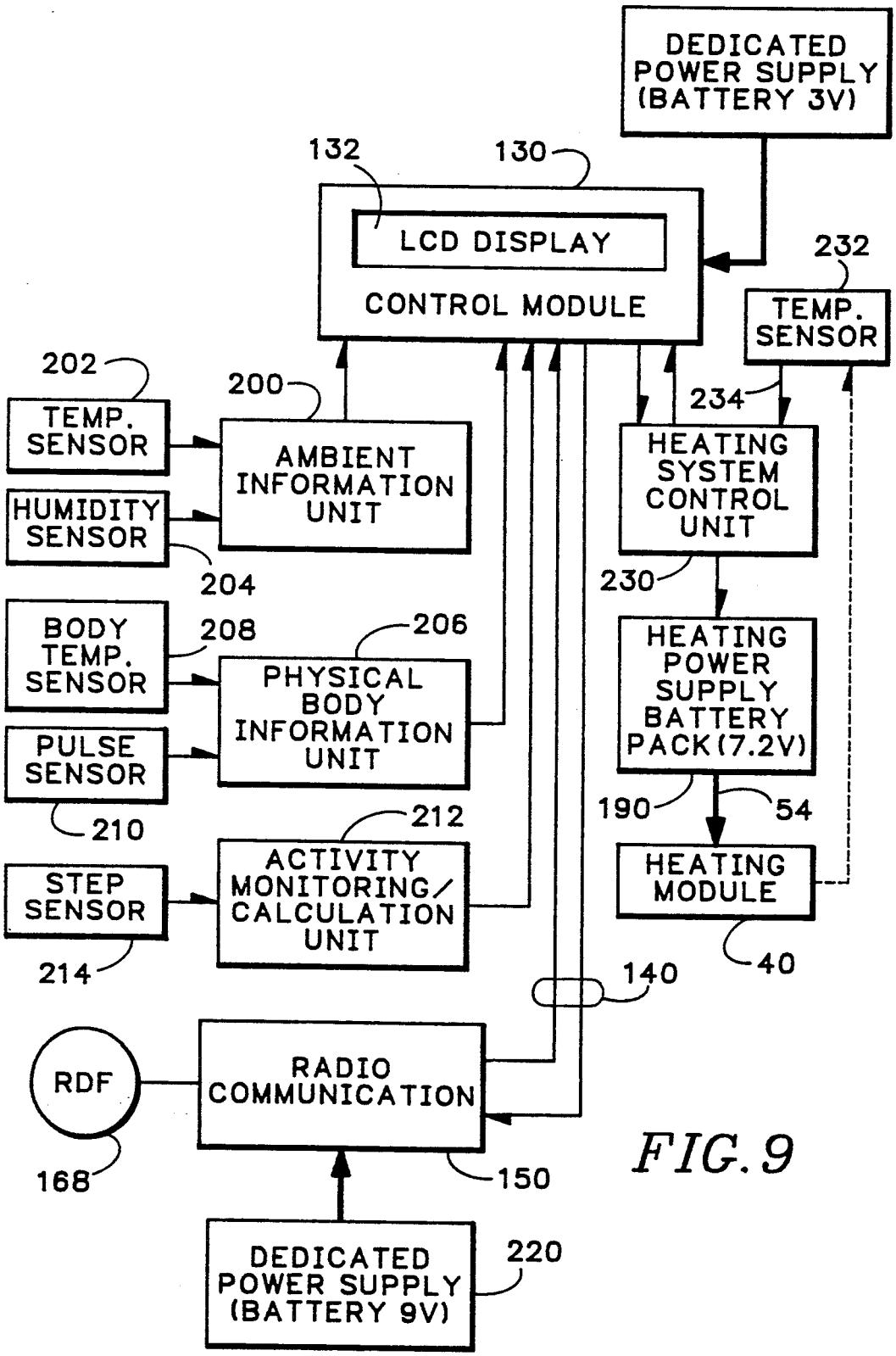
FIG. 9 is a control logic block diagram of the garment system of FIG. 1.

FIG. 9 is a functional block diagram showing the interconnection of various functional modules, parameter and control information. In this diagram, heavy lines with full arrowheads are used to indicate power connections and lighter lines with half arrowheads are used to indicate flow of parameter data and control signals.

An ambient information unit 200 is connected to a temperature sensor 202 and to a humidity sensor 204 to receive ambient information. Ambient information thus acquired may be processed in the ambient information unit 200 and the resulting data is passed on to the control module 130 as an input parameter.

A physiological information unit 206 is coupled to a body or skin temperature sensor 208 and to a pulse sensor 210 to acquire physiological information from the user. This information may be processed in the physiological information unit and the resulting data, for example pulse rate, is provided to the control module 130 as another input parameter.

An activity monitoring unit 212 is coupled to a step sensor 214, much like a pedometer, to acquire step data. The activity monitoring unit 212 includes means for calculating such things as number of steps, step rate, moving averages, etc. for use as input parameters. In practice, the ambient information unit 200, the physiological information unit 206, and the activity monitoring unit 212 are likely to be integrated into the control module 130.

The radio communication module 150 is coupled to the control module 130 by a cable 140. Cable 140 provides a two-way link between the communication module and the control module. In this way, the communication module can be activated as a fault condition response, and it can provide information (e.g. incoming signal strength or battery low) to the control module as an input parameter. A dedicated power supply 220 is provided for powering the communication module and preferably is integrally housed within the communication module 150.

Figure 10:
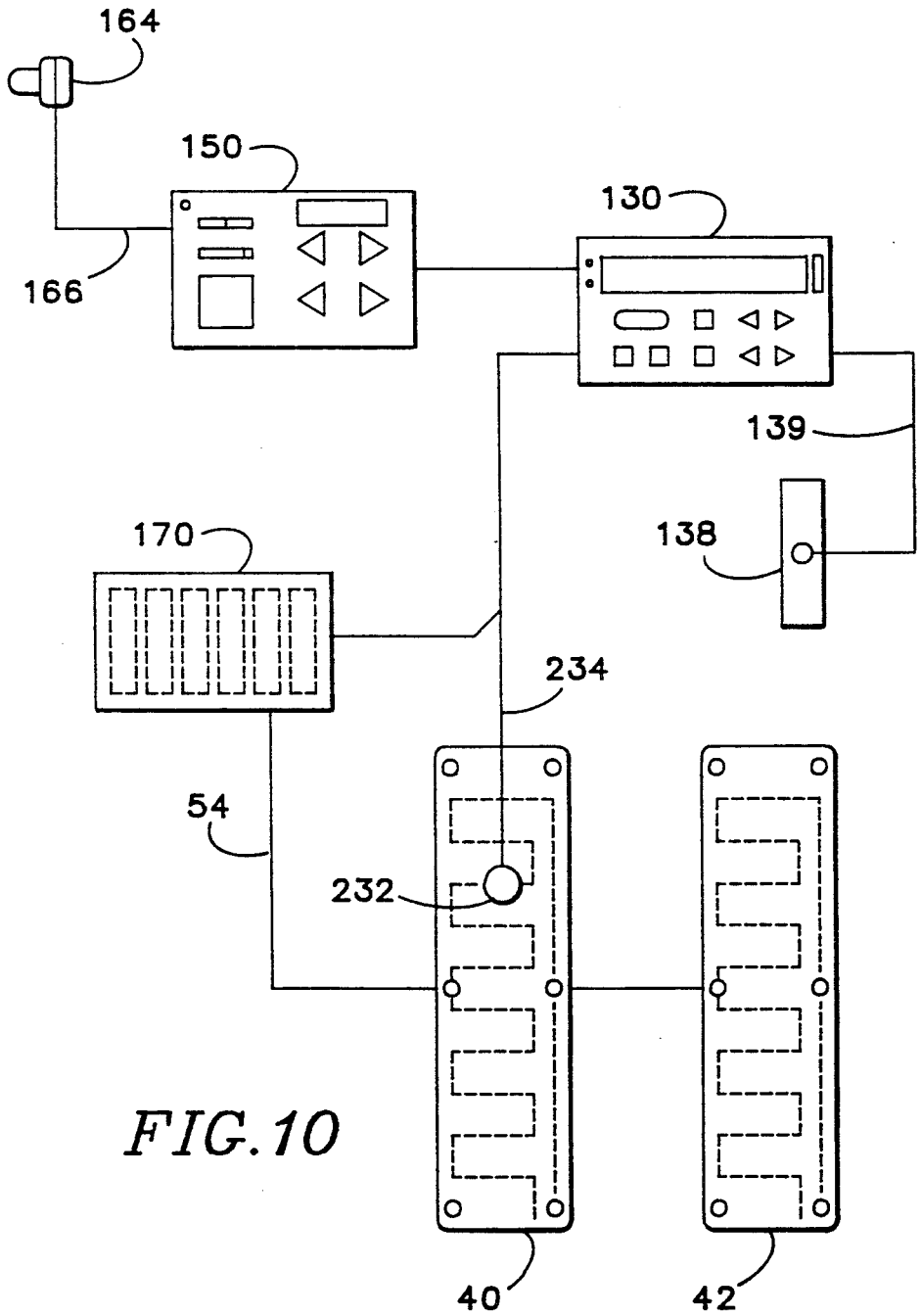
FIG. 10 is a diagram showing interconnection of various functional modules of the garment system of FIG. 1.

A heating system control unit 230 is coupled to the control module 130 and is coupled to a temperature sensor 232. Temperature sensor 232 is disposed adjacent heating module 40 to sense the temperature in that vicinity and provide feedback to the heating system control unit 230. The control unit 230, in turn, is connected to the heating module power supply 190 to control it. The power supply 190 is connected over a suitable cable 54 to provide power to heating module 40 as described above. FIG. 10 illustrates the physical interconnection of the modules described above.

Figure 11:
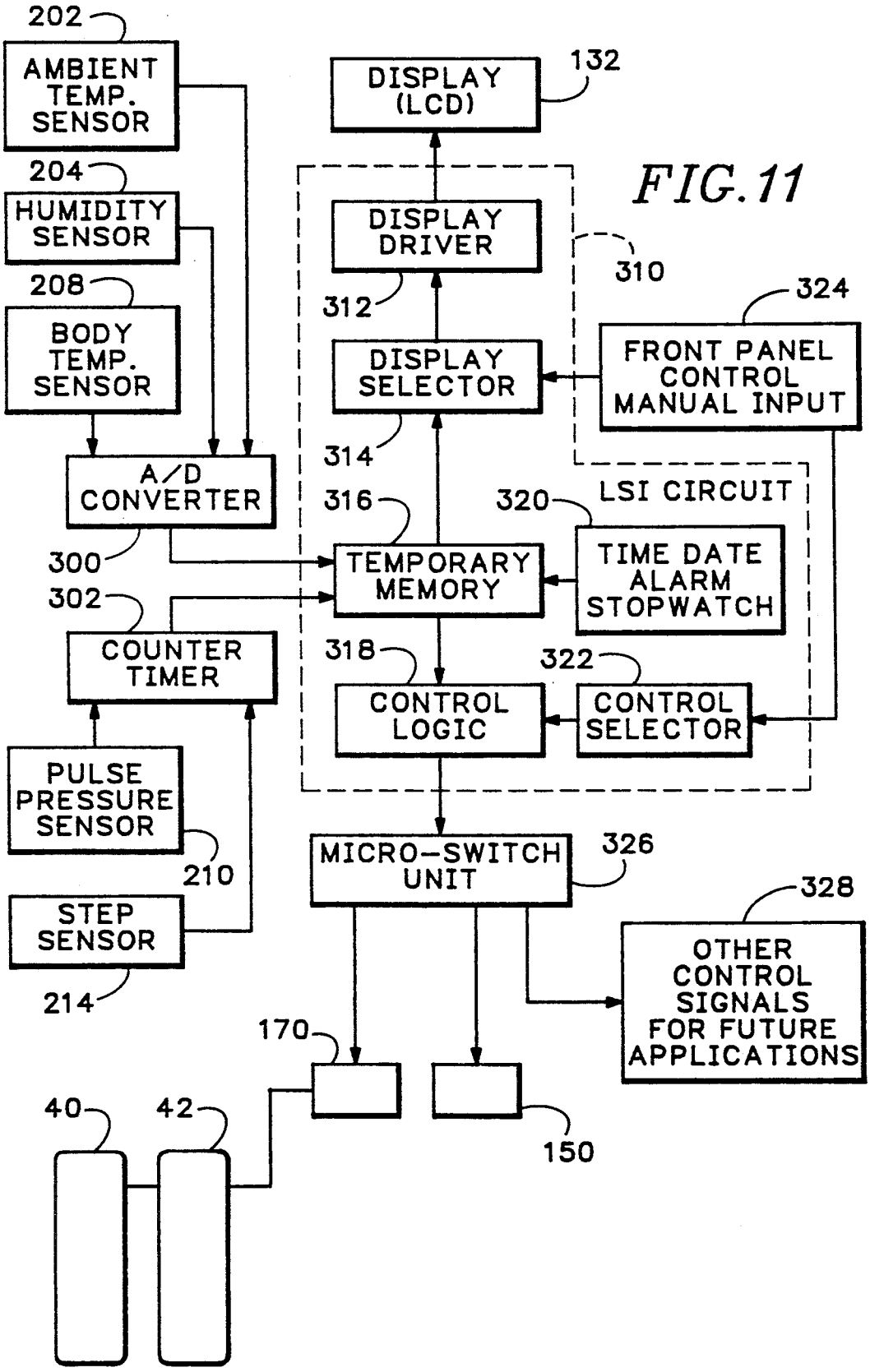
FIG. 11 is a block diagram showing interconnection among various sensors and functional modules of the garment system of FIG. 1.

FIG. 11 is a block diagram of an operative example of the electronic aspects of the invention. The ambient temperature sensor 202 may be a thermistor (semiconductor temperature sensor) such as an NTC (negative temperature coefficient) thermistor available from Keystone Carbon Co. The same type of apparatus may be used as a body temperature sensor 208.

The humidity sensor 204 may be any of various commercially available transducers which are sensitive to humidity changes. Examples include a humidity sensitive resistor or a humidity sensitive capacitor. Sensors 202, 204 and 208 are coupled to an A/D (analog to digital) converter 300. A wide variety of A/D converters are known and commercially available.

The pulse sensor 210 may be a pressure sensitive transducer or a differential pressure sensor which can detect pulse pressure or pressure changes. The step sensor 214 can be a mechanical switch or a mercury switch arranged to switch ON and OFF responsive to the user's hand movement while walking or running. Sensors 210 and 214 are coupled to a counter/timer apparatus 302 for counting and timing the sensor input data to determine pulse rates and cadence, and for providing such information in digital form. Output data from A/D converter 300 and the counter/timer 302 are input to a temporary memory 316.

Additional control circuitry, circumscribed by dashed line 310, may be implemented in various ways using integrated circuits or a custom LSI circuit. Circuitry 310 includes a time, date, alarm and stop watch unit 320 for providing those functions. Data from the time, date, alarm and stopwatch unit 320 is provided into the temporary memory 316.

A display selector unit 314 receives input from a front panel control 324 and from the temporary memory 316, and provides display data to a display driver unit 312. The display driver unit 312, in turn, is coupled to the display 132. LCD displays are available in a wide variety of formats and digits, as are commonly used in small watches, alarm clocks, calculators, and the like.

Front panel control 324 also provides input to a control selector 322 which, in turn, drives control logic 318. The control logic 318, in response to inputs from the temporary memory 316 and the control selector 322 controls a microswitch unit 326. Microswitch unit 326 can be formed of various digital integrated circuit devices such as the 7400 series of logic devices manufactured by National Semiconductor Corp. The microswitch unit 326, in turn, provides control signals to the heating module power supply, the radio communication module 150, and such other functional modules as may be provided.

Preferably, the A/D converter 300 and counter timer unit 302 are included along with the other circuitry within dashed line 310, within the control and display module 130. Indeed, all of the foregoing could be implemented in a custom LSI device. Details of implementation of the functions and features disclosed above will be apparent to an electrical engineer of ordinary skill in the art, so they need not be disclosed further.

Having illustrated and described the principles of my invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A multi-functional garment system wearable by a user comprising:

a jacket-like outer shell garment;

an inflatable insulation module detachably connectable to an interim surface of the outer shell garment and sized to fit within the outer shell garment;

fastening means in the outer shell garment for detachably connecting the insulation module;

an electric heating module detachably connectable to an interior surface of the insulation module for warming the user;

fastening means disposed on the interior surface of the insulation module for detachably connecting the heating module;

input means connectable to the user's person for providing a physiological input parameter; and an electronic control module detachably connectable to the outer shell garment and connectable to the input means and to the heating module for monitoring the input means and for controlling the heating module responsive to the physiological input parameter.

2. A garment system according to claim 1 wherein the control module includes means for providing an indication to the user responsive to the physiological input parameter.

3. A garment system according to claim 1 wherein the control module further includes:

means for storing a parameter limit settable by the user;

means for storing a fault condition response selectable by the user;

means for detecting a fault condition when an input parameter exceeds the corresponding stored parameter limit; and means responsive to the detective of a fault condition for exercising the corresponding stored fault condition response.

4. A garment system according to claim 3 further comprising a pulse sensor connectable to the user's person to provide an indication of the user's pulse and wherein:

the control module includes means responsive to the pulse sensor for calculating the user's pulse rate as the input parameter and includes an audible alarm;

the stored parameter limit is a high pulse rate limit; and the stored fault condition response is actuation of the audible alarm to signal the user.

5. A garment system according to claim 3 further comprising a pulse sensor connectable to the user to provide an indication of the user's pulse and wherein:

the control module includes means responsive to the pulse sensor for calculating the user's pulse rate as the input parameter;

the stored parameter limit is a low pulse rate limit; and the stored fault condition response is actuation of the heating module to warm the user.

6. A garment system according to claim 3 wherein:

the input means includes a skin temperature sensor connectable to the user to provide an indication of the user's skin temperature as the input parameter;

the stored parameter limit is a low skin temperature limit; and the stored fault condition response is actuation of the heating module to warm the user.

7. A garment system according to claim 3 further comprising a step sensor connectable to the user to provide an indication of the user's step and wherein:

the control module includes means responsive to the step sensor for calculating a step cadence as the input parameter;

the stored parameter limit is a step cadence limit; and the stored fault condition response is providing an indication to the user of the fault condition.

8. A garment system according to claim 3 further comprising a communication module detachably connectable to the outer shell garment;

the communication module being connectable to the control module so as to allow actuating the communication module as a stored fault condition response.

9. A garment system according to claim 8 wherein the communication module includes means for receiving a radio direction finder antenna for using the communication module as a navigational aide.

10. A multi-functional garment system wearable by a user comprising:

a jacket-like outer shell garment;

an inflatable insulation module detachably connectable to an interior surface of the outer shell garment and sized to fit within the outer shell garment;

fastening means in the outer shell garment for detachably connecting to the insulation module;

an electric heating module detachably connectable to an interior surface of the insulation module for warming the user;

fastening means in the insulation module for detachably connecting the heating module;

input means for providing an ambient input parameter; and electronic control means detachably connectable to the outer shell garment and connectable to the input means and to the heating module for monitoring the input means and for controlling the heating module responsive to the ambient input parameter.

11. A garment system according to claim 10 wherein the control means includes means for providing an indication to the user responsive to the ambient input parameter.

12. A garment system according to claim 10 wherein the control means further includes:

means for storing a parameter limit settable by the user;

means for storing a fault condition response selectable by the user;

means for detecting a fault condition when an input parameter exceeds the corresponding stored parameter limit; and means responsive to the detection of a fault condition for exercising the corresponding stored fault condition response.

13. A garment system according to claim 10 wherein the ambient input means includes an ambient temperature sensor to provide an indication of the ambient temperature as the input parameter.

14. A multi-functional garment system according to claim 10 wherein the ambient input parameter is ambient temperature and the control means includes:

means for storing an ambient temperature limit settable by the user;

means for detecting an indicating a fault condition when the ambient temperature falls below the stored limit; and means responsive to the indication of a fault condition for actuating the heating module.

15. A multi-functional garment system according to claim 10 wherein:

the outer shell garment includes recess for housing the control means;

the control means is sized to fit within the said recess; and the shell garment further includes wiring means extending between a predetermined location in the garment for connection to the heating module and the said recess for connection to the control means.

16. A multi-functional garment system comprising:

a jacket-like outer shell garment wearable having a first closable recess of a first predetermined size located adjacent a distal end of one sleeve and a second closable recess of a second predetermined size located in a shoulder region;

an electronic control module sized to fit within the first recess;

sensing means in the control module for sensing a predetermined ambient parameter;

clock means in the control module for providing an elapsed time;

a physiological sensor connectable to the user's person for sensing a predetermined physiological parameter of the user;

first means for detachably coupling the physiological sensor to the control module;

visual display means coupled to the control module for displaying at least one of the sensed physiological parameter, the elapsed time, and the ambient parameter;

a radio transmitter, sized to fit within the second recess and having an emergency mode of operation for periodically transmitting radio signals at a predetermined emergency frequency;

second means disposed within said one sleeve for detachably coupling the radio transmitter to the control unit;

heating means positioned within and removably connectable to the outer shell garment and coupled through the said sleeve to the control module;

limit means in the control module for setting a parameter limit value defining a respective fault condition for at least one of the sensed physiological parameter, the elapsed time, and the ambient parameter;

means in the control module for setting a respective action to be taken in response to a fault condition for at least one of the sensed physiological parameter, the elapsed time, and the ambient parameter, each such response action including at least one of displaying a message on the display means, activating the heating means to warm the user, and activating the radio transmitter emergency mode; and means in the control module for effecting the corresponding action in response to each fault condition.

17. A multi-functional garment system according to claim 16 further comprising a sheet of semiconductor thermal electric material removably connectable to the outer shell garment for cooling the user and coupled for control to the control module, and wherein said response actions include activating the cooling means.

* * * * *